US011455980B2

(12) United States Patent
You et al.

(10) Patent No.: US 11,455,980 B2
(45) Date of Patent: Sep. 27, 2022

(54) VEHICLE AND CONTROLLING METHOD OF VEHICLE

(71) Applicants: HYUNDAI MOTOR COMPANY, Seoul (KR); KIA MOTORS CORPORATION, Seoul (KR); Korea Advanced Institute of Science and Technology, Daejeon (KR)

(72) Inventors: Jung Keun You, Suwon-si (KR); MunHwan Cho, Seoul (KR); Joongkwan Kim, Hwaseong-si (KR); Myoungok Lee, Hwaseong-si (KR); Kaangdok Yee, Yongin-si (KR); Youngjin Park, Daejeon (KR); Yeongseok Kim, Goyang-si (KR)

(73) Assignees: Hyundai Motor Company, Seoul (KR); Kia Motors Corporation, Seoul (KR); Korea Advanced Institute of Science and Technology, Daejeon (KR)

( * ) Notice: Subject to any disclaimer, the term of this patent is extended or adjusted under 35 U.S.C. 154(b) by 0 days.

(21) Appl. No.: 16/704,237

(22) Filed: Dec. 5, 2019

(65) Prior Publication Data

US 2020/0388266 A1 Dec. 10, 2020

(30) Foreign Application Priority Data

Jun. 10, 2019 (KR) ..... 10-2019-0068025

(51) Int. Cl.
*G10K 11/175* (2006.01)
*H04R 5/02* (2006.01)
(Continued)

(52) U.S. Cl.
CPC ..... *G10K 11/175* (2013.01); *G10L 25/51* (2013.01); *H04R 3/12* (2013.01); *H04R 5/023* (2013.01);
(Continued)

(58) Field of Classification Search
CPC ..... H04R 2499/11; H04R 1/083; H04R 2460/01; H04R 3/005; H04R 1/028; H04R 2201/107; H04R 27/00; H04R 1/1008; H04R 1/342; H04R 2201/023; H04R 2227/003; H04R 2410/05; H04R 2499/13;
(Continued)

(56) References Cited

U.S. PATENT DOCUMENTS

2009/0220112 A1* 9/2009 Fincham ..... H04S 1/002 381/302
2013/0170655 A1* 7/2013 Satoyoshi ..... H04K 3/825 381/56
(Continued)

FOREIGN PATENT DOCUMENTS

KR 10-1816691 B1 2/2018

*Primary Examiner* — Lun-See Lao
(74) *Attorney, Agent, or Firm* — Fox Rothschild LLP

(57) ABSTRACT

A vehicle and a controlling method thereof are disclosed. The vehicle includes a first seat in which a talker is seated; a second seat in which a passenger is seated; a plurality of speakers provided in the first seat and the second seat; a microphone for receiving the voice of the passenger or the voice of the talker; and a controller configured to control the speaker to output a masking sound tuned based on the voice of the talker or the voice of the passenger.

18 Claims, 9 Drawing Sheets

(51) Int. Cl.

| | |
|---|---|
| ***H04R 5/04*** | (2006.01) |
| ***H04R 29/00*** | (2006.01) |
| ***H04S 1/00*** | (2006.01) |
| ***G10L 25/51*** | (2013.01) |
| ***H04R 3/12*** | (2006.01) |

(52) U.S. Cl.
CPC ..... *H04R 5/04* (2013.01); *H04R 29/002* (2013.01); *H04S 1/007* (2013.01); *H04R 2499/13* (2013.01)

(58) Field of Classification Search
CPC ..... H04R 25/505; H04R 5/033; H04R 1/10; H04R 2201/029; H04R 2460/13; H04R 25/50; H04R 25/554; H04R 3/02; H04R 3/04; H04R 5/023; H04R 5/04; H04R 17/00; H04R 1/1041; H04R 1/105; H04R 1/1083; H04R 1/14; H04R 1/225; H04R 1/288; H04R 1/406; H04R 2201/405; H04R 2203/12; H04R 2217/03; H04R 2225/39; H04R 2225/43; H04R 2227/007; H04R 2227/009; H04R 2400/01; H04R 2410/03; H04R 2410/07; H04R 2420/03; H04R 2420/09; H04R 2430/01; H04R 2430/03; H04R 2499/10; H04R 2499/15; H04R 25/00; H04R 25/305; H04R 25/356; H04R 25/407; H04R 25/70; H04R 25/75; H04R 27/04; H04R 29/00; H04R 29/001; H04R 29/002; H04R 3/002; H04R 5/0335; H04R 7/045; G10K 11/175; G10K 11/16; G10K 11/17885; G10K 11/17857; G10K 11/17873; G10K 2210/108; G10K 11/17861; G10K 11/04; G10K 11/162; G10K 11/1752; G10K 11/1754; G10K 11/178; G10K 11/17815; G10K 11/1785; G10K 11/17881; G10K 2210/1081; G10K 2210/505; G10K 2210/509
USPC ..... 381/302, 86
See application file for complete search history.

(56) References Cited

U.S. PATENT DOCUMENTS

| | | | | |
|---|---|---|---|---|
| 2015/0127351 | A1* | 5/2015 | Buck | G10L 21/02 704/270 |
| 2016/0180846 | A1* | 6/2016 | Lee | G10L 15/22 704/251 |
| 2016/0196818 | A1* | 7/2016 | Christoph | H04K 3/84 381/71.6 |
| 2017/0193991 | A1* | 7/2017 | Heber | G06F 3/165 |
| 2017/0278512 | A1* | 9/2017 | Pandya | G10L 15/08 |
| 2019/0045319 | A1* | 2/2019 | Hotary | G06K 9/00832 |

* cited by examiner (a)

(b)

(c)

(a)

(b)

VEHICLE AND CONTROLLING METHOD OF VEHICLE

CROSS-REFERENCE TO RELATED APPLICATION(S)

This application is based on and claims priority under 35 U.S.C. § 119 to Korean Patent Application No. 10-2019-0068025, filed on Jun. 10, 2019, in the Korean Intellectual Property Office, the disclosure of which is incorporated by reference herein in its entirety.

BACKGROUND

1. Field

The disclosure relates to a vehicle and a controlling method thereof.

2. Description of the Related Art

Recently, when a communication such as a telephone or a conversation is made in a vehicle, various techniques for maintaining the privacy of a talker have been developed.

When the talker in the vehicle makes a call, although there is a need to protect the talker's privacy, another passenger inside the vehicle can hear the talker's call and leak the call, thereby failing to protect the talker's privacy.

The disclosure of this section is to provide background information relating to the invention. Applicant does not admit that any information contained in this section constitutes prior art.

SUMMARY

Therefore, it is an aspect of the disclosure to provide a vehicle capable of protecting the privacy of a talker on board by generating a masking sound that can cancel the voice of the talker based on talker voice information of the vehicle, and by outputting the generated masking sound through a speaker, and a controlling method thereof.

It is another aspect of the disclosure to provide a vehicle capable of outputting a separate background sound from a speaker provided in the vehicle when the talker of the vehicle calls, and a controlling method thereof.

It is another aspect of the disclosure to provide a vehicle capable of preventing a sound generated from the other seat from being transmitted to a seat present inside the vehicle, by allowing a speaker to output a masking sound, and a controlling method thereof. In accordance with an aspect of the disclosure, a vehicle includes a first seat in which a talker is seated; a second seat in which a passenger is seated; a plurality of speakers provided in the first seat and the second seat; a microphone configured to receive the passenger's voice or the talker's voice; and a controller configured to control the speaker to output a masking sound tuned based on the talker's voice or the passenger's voice.

The speaker may be provided in a headrest of the first seat or the second seat.

The controller may control the speaker to reduce the volume of the masking sound output for a predetermined time or to allow the masking sound to have an asymmetric waveform.

The vehicle may further include a speaker provided to the left and right of the headrest of the second seat and having two channels, and the controller may control a speaker provided to the left and right of the headrest of the second seat and having two channels so that the masking sound is delayed and output.

The controller may output a background sound.

The vehicle may further include a GPS sensor, and the controller may output the background sound based on location information of the vehicle.

The microphone may receive the masking sound output through the speaker and the voice echo of the talker, and the controller may adjust the AGC sensitivity of the microphone based on the magnitude of the background sound and the masking sound output through the speaker.

The controller may determine a frequency of the voice of the talker and a phase of the voice of the talker, and output a tuned masking sound that cancels the determined frequency.

The controller may store the plurality of background sounds and output the masking sound based on a preset criterion when the talker starts speaking or when the background sounds change.

The vehicle may further include an input unit configured to receive an operation start command.

In accordance with another aspect of the disclosure, a method of controlling a vehicle includes receiving the passenger's voice or the talker's voice by a microphone and controlling the speaker to output a masking sound tuned based on the talker's voice or the passenger's voice.

The controlling may include a speaker provided in a headrest of a first seat or a second seat.

The controlling may include reducing the volume of the masking sound output for a predetermined time or controlling the speaker so that the masking sound has an asymmetric waveform.

The controlling may include controlling the speakers provided on the left and right of the headrest of the second seat and having two channels so that the masking sound is delayed output.

The controlling may include outputting a background sound.

The control method of the vehicle may further include outputting the background sound based on the position information of the vehicle.

The method may further include receiving a masking sound output through the speaker and a voice echo of the talker, and adjusting the AGC sensitivity of the microphone based on the magnitude of the background sound and the masking sound output through the speaker.

The controlling may include determining a frequency of the voice of the talker and a phase of the voice of the talker, and outputting a tuned masking sound that cancels the determined frequency.

The controlling may include outputting the masking sound based on a preset criterion when the talker starts speaking or when the background sound changes.

The method may further include receiving an operation start command.

A further aspect of the invention provides a vehicle including a first seat in which a first passenger who is talking over a telephone is seated; a second seat in which a second passenger is seated; a plurality of speakers provided around or in the first seat and the second seat; a microphone configured to receive the first passenger's voice; and a controller configured to control the speaker to output a masking sound tuned based on the first passenger's voice.

BRIEF DESCRIPTION OF THE DRAWINGS

These above and/or other aspects of the disclosure will become apparent and more readily appreciated from the following description of embodiments, taken in conjunction with the accompanying drawings in which.

DETAILED DESCRIPTION

Figure 1:
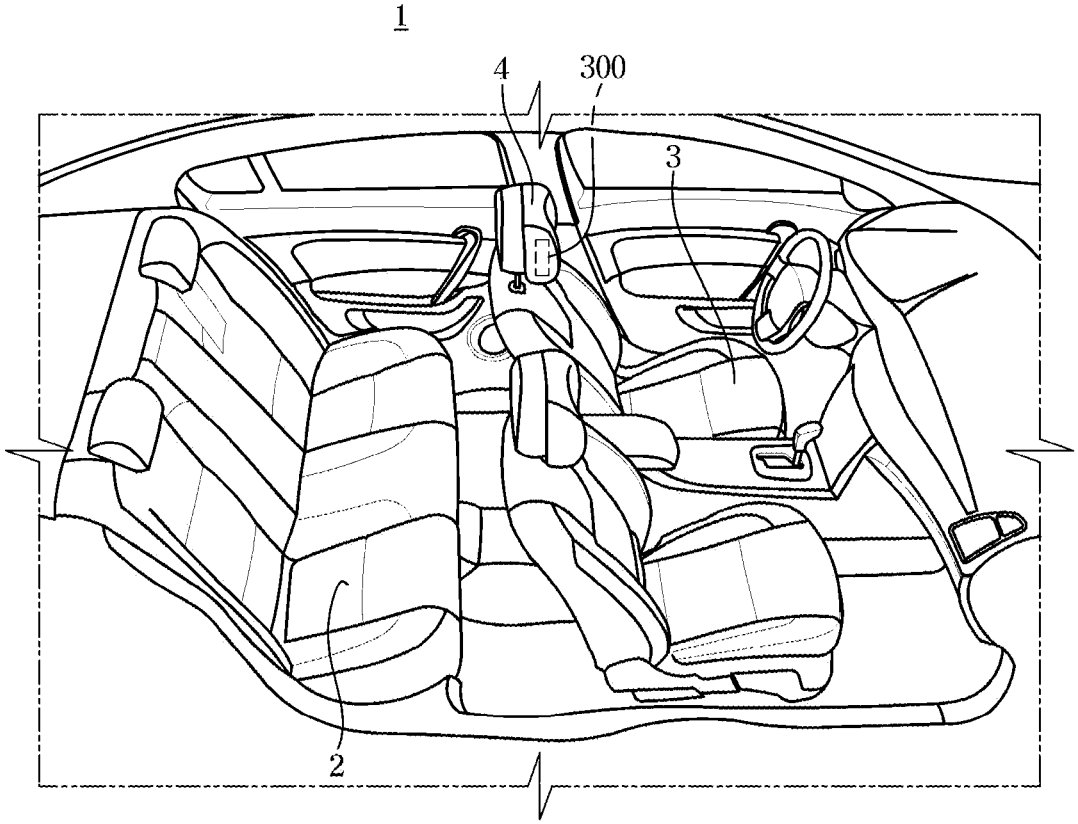
FIG. 1 illustrates an interior of a vehicle according to an embodiment of the disclosure.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, embodiments will now be described more fully hereinafter with reference to the accompanying drawings. The embodiments may, however, be embodied in many different forms and should not be construed as being limited to the embodiments set forth herein. These embodiments are provided so that this disclosure will be thorough and complete and will fully convey the embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the embodiments of the present disclosure, examples of which are illustrated in the accompanying drawings, wherein like reference numerals refer to like elements throughout.

In one implementation, a physical device is used to separate the seat of the vehicle, but incomplete sound control is performed, and thus the privacy of the vehicle talker is still invaded or intruded.

Figure 2:
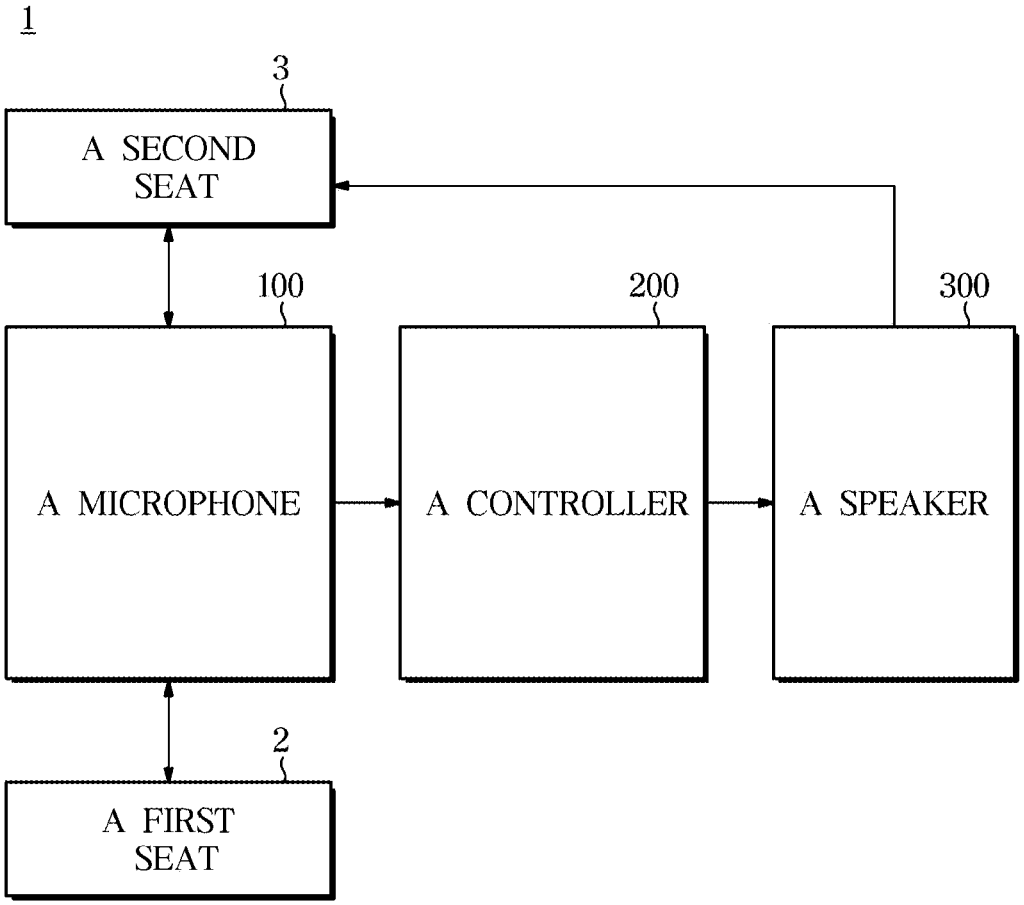
FIG. 2 is a control block diagram of the vehicle according to the embodiment of the disclosure.

FIGS. 1 and 2 show a vehicle 1 according to the disclosed embodiment.

Referring to FIGS. 1 and 2, the vehicle 1 according to the disclosed embodiment includes a first seat 2, a second seat 3, a headrest 4, a microphone 100, a controller 200, and a speaker 300.

The first seat 2 according to the disclosed embodiment means a seat provided in the vehicle 1 and occupied by a talker. The second seat 3 according to the disclosed embodiment means a seat provided in the vehicle 1 and occupied by a passenger of the vehicle 1 other than the talker.

A talker means a person who speaks on the vehicle 1 or makes a phone call or talks, and a passenger means a person other than the talker in the vehicle 1.

On the other hand, the first seat 2 and the second seat 3 does not mean only a single seat, but in the case of a plurality of talkers, the first seat may be provided in plural. In addition, when there is a plurality of passengers existing in the vehicle 1 in addition to the talker, the second seat 3 may be provided in plural numbers.

The microphone 100 refers to a device provided in the vehicle 1 to receive or detect a sound generated inside the vehicle 1.

The microphone 100 according to the disclosed embodiment may receive a voice signal of the talker seated in the first seat 2.

In addition, the microphone 100 may detect a sound generated through the first speaker and the second speaker provided in the headrest 4 of the vehicle 1. The microphone 100 may detect the sound generated by the speaker existing in the vehicle 1 except for the second speaker.

In addition, the microphone 100 according to the disclosed embodiment may include a microphone to which a REF microphone tuning technique is applied.

The REF microphone tuning technology detects sound by a microphone from a plurality of speakers provided in the vehicle 1, removes echoes of the received talker's voice signal based on the detected sound, and adjusts the received talker's voice signal. It is a control method to amplify or reduce the size of audio signal. Accordingly, the microphone 100 according to the disclosed embodiment may include a microphone to which a REF microphone tuning technique is applied, and may automatically control corresponding to auto gain control (AGC) an input value of an audio signal of a talker input to the microphone.

On the other hand, the microphone 100 is provided in the first seat 2 and the second seat 3, and may include a singular or plural microphone depending on the type of the vehicle 1.

The controller 200 controls the speaker 300 to generate a masking sound that cancels the talker's voice from the speaker based on the voice of the talker received by the microphone 100, and the controller 200 controls an input value of the microphone 100 based on the generated masking sound.

Specifically, the controller 200 may automatically control the sensitivity of the input value of the voice signal of the talker input to the microphone based on the sound generated in the vehicle 1, thereby controlling the voice of the talker.

According to the embodiment, the speaker 300 may generate a masking sound, and the controller 200 may REF tune an input value of the microphone 100 based on the generated masking sound.

In addition, the controller 200 according to the disclosed embodiment may amplify or reduce the voice signal input value of the talker based on the size of the masking sound or the background sound generated by the speaker 300 and adjust the echo of the talker voice.

However, the controller 200 may control the microphone 100 based on various sounds generated from a plurality of speakers other than the first speaker 2 and the second speaker 3 provided in the vehicle 1 in addition to the masking sound or the background sound.

The controller 200 controls the speaker 300 to generate a masking sound that cancels the talker's voice from the speaker 300 based on the voice of the talker input from the microphone 100.

In addition, the controller 200 may control the speaker 300 to generate a tuned masking sound, and may control the speaker 300 to output a background sound from the speaker 300.

A process in which the controller 200 controls the microphone 100 and the speaker 300 will be described later with reference to FIGS. 3 to 5.

On the other hand, the controller 200 may be implemented by a memory for storing algorithm or data about programs that reproduces the algorithm for controlling the operation of the components in the vehicle 1, and a processor that performs the operation by using the data stored in the memory. In this case, the memory and the processor may be implemented as separate chips. Alternatively, the memory and the processor may be implemented in a single chip.

The speaker 300 outputs a masking sound that cancels the talker's voice based on the talker's voice information determined by the controller 200.

Specifically, the masking sound may be a sound having a frequency that cancels the voice frequency of the talker. In addition, the speaker 300 may output the tuned masking sound.

Figure 5:
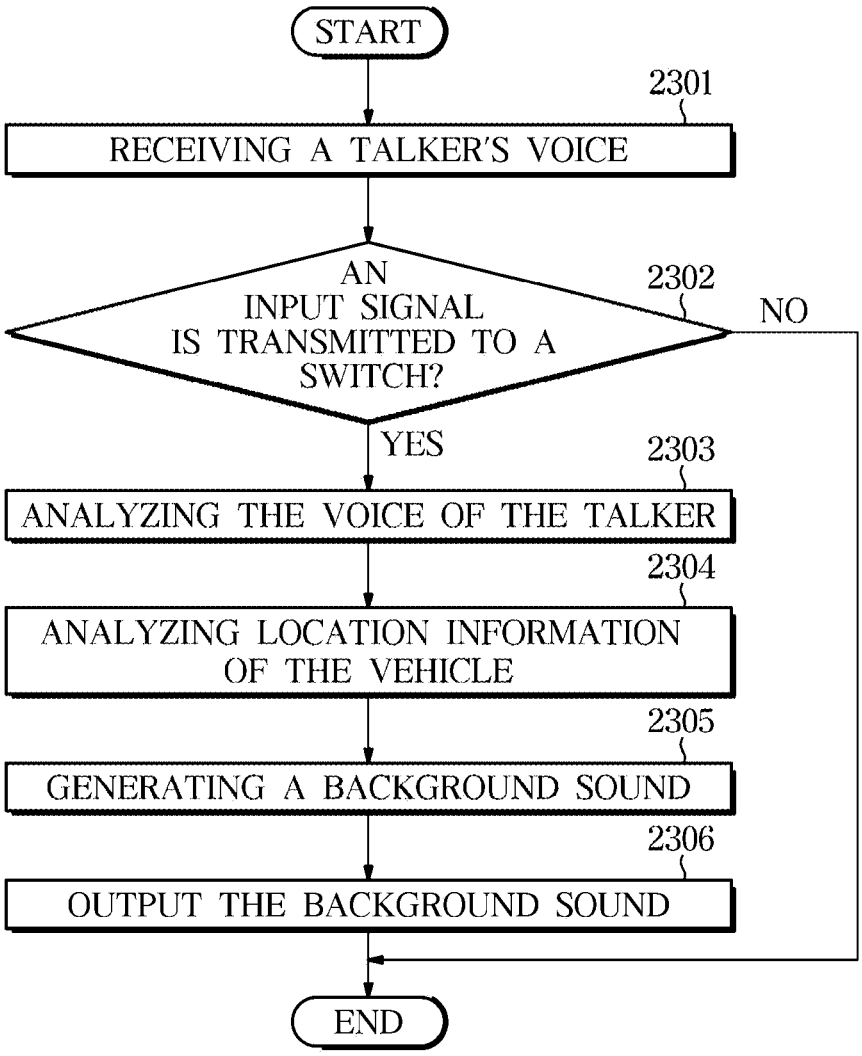
FIG. 5 is a flowchart illustrating the generation and output of a background sound by the controller of the vehicle according to the disclosed embodiment.

Detailed information on the tuned masking sound is shown in FIG. 5 to be described later.

On the other hand, the speaker 300 may be provided in the headrest 4. Specifically, the speaker 300 may be provided in the headrest 4 of the first seat 2 and the second seat 3, respectively, and may be provided to have two channels on the left and right of each headrest 4.

According to the disclosed embodiment, the speaker 300 is provided on the left and right of the headrest 4 of the first seat 2 and the second seat 3, respectively, and the installation angle of the speaker 300 is rearward of the seating surface of the talker or the user, or it can be positioned at 45° to the rear side.

However, the position and installation angle of the speaker 300 may vary depending on the type and user definition of the vehicle.

Hereinafter in FIGS. 3 to 5, a flowchart in which the controller 200 controls the speaker 300 to output masking sound based on the voice information of the talker received by the microphone 100 will be described.

Figure 3:
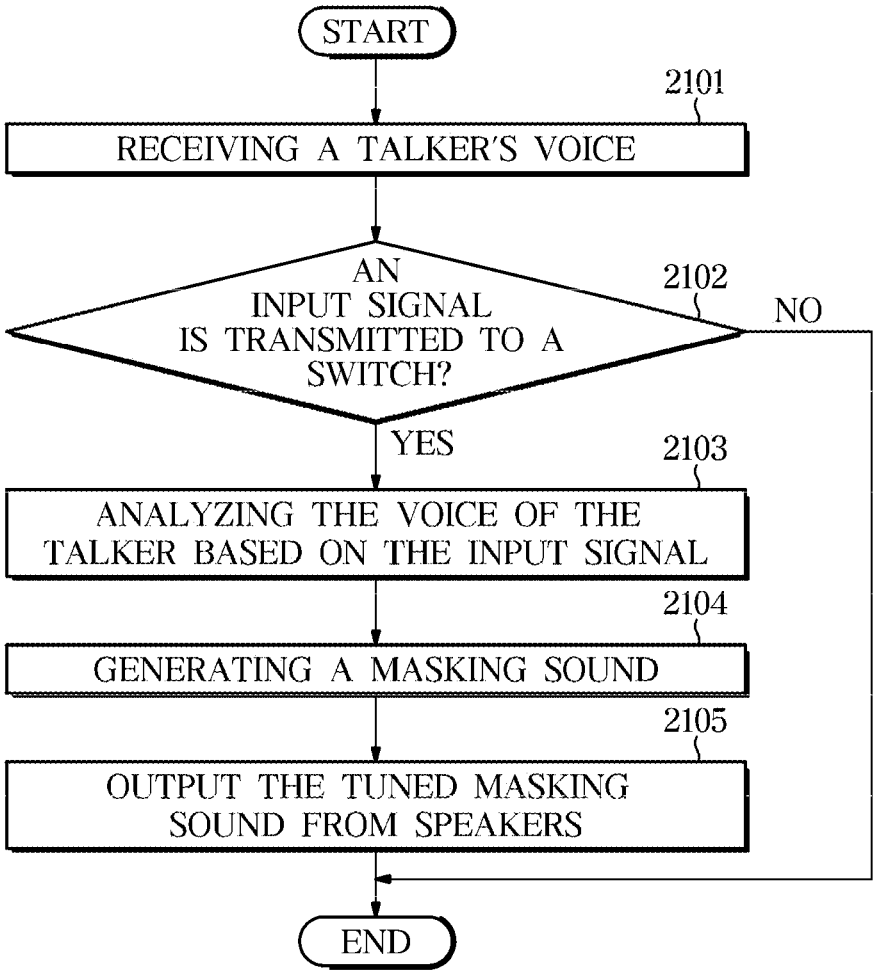
FIG. 3 is a flow chart illustrating that a controller of the vehicle generates and outputs a tuned masking sound according to the embodiment of the disclosure.

FIG. 3 is a flowchart illustrating a process of controlling the speaker 300 to output the masking sound by the controller 200 according to the disclosed embodiment.

The controller 200 receives the talker's voice from the microphone 100 (2101).

The talker may transmit an input signal to a switch for the controller 200 to generate a masking sound while uttering (2102).

The switch is just one example of a configuration to receive an input signal for starting the masking sound of the controller 200. The signal input by the talker may include various signals that the talker can implement, such as not only pressing a switch provided in the vehicle 1 using a hand of the talker, but also a voice command or a facial expression of the talker.

Therefore, the switch may include a hardware device such as various buttons or switches, pedals, keyboards, mice, trackballs, levers, handles or sticks for user input.

The switch may also include a graphical user interface (GUI), e.g., a device, such as a touch pad for user input. The touch pad may be implemented as a touch screen panel (TSP) to form a mutual layer structure with a display.

When the display is implemented by the touch screen panel (TSP) having a layer structure with the touch pad, the display may be used as a switch.

The controller 200 analyzes the voice of the talker based on the input signal of the talker (2103).

However, when there is no input signal from the talker, the controller 200 does not generate a masking sound and ends the control process.

Specifically, analyzing the voice of the talker by the controller 200 may include analyzing information related to the size of the talker voice, the amplitude, and the frequency period of the talker voice waveform.

In addition, the controller 200 may also analyze voice information capable of inferring the talker's emotion such as tremor and height of the talker's voice.

The controller 200 generates a masking sound based on the analyzed talker's voice (2104).

Specifically, the masking sound may be a sound that cancels the talker's voice. In addition, the controller 200 may tune the masking sound to effectively cancel the talker's voice.

The method of tuning the masking sound by the controller 200 may be a method of decreasing (fading out) the size of the masking sound for a predetermined time. The predetermined time may be a time for most effectively canceling the talker's voice based on the talker's voice.

According to the disclosed embodiment, the predetermined time for the controller 200 to decrease the size of the masking sound may be a time based on voice information of the talker and spatial information inside the vehicle 1.

According to the embodiment, an initial value before tuning of the masking sound may be a size at which the talker voice is detected in the vehicle.

Specifically, when the talker starts to speak, the controller 200 may set the volume of the talker's voice as the initial value before tuning the masking sound in consideration of the ringing phenomenon depending on the space of the vehicle 1.

When the talker starts to speak, the controller 200 controls the speaker 300 so that the speaker 300 outputs the setting initial value before tuning the masking sound, and sets a repetitive period in consideration of the talker talk period. And the controller 200 tunes the masking sound to smaller and smaller.

In addition, the method of tuning the masking sound by the controller 200 may be a method of delaying the sound output from the speaker 300 provided on the left and right of the headrest 4 alternately for a predetermined time.

The predetermined time may be a time for most effectively canceling the talker's voice based on the talker's voice.

In detail, the controller 200 may set the size of the masking sound before tuning, to the same size as the voice of the talker. However, the size of the masking sound before tuning is not limited thereto and may vary based on user definition.

When the talker starts to speak, the controller 200 controls the speaker 300 to alternately output the masking sound having the magnitude of the masking sound before the tuning from the speaker 300 provided on the left and right of the headrest 4. The predetermined time may be set based on the voice information period of the talker. However, the predetermined time is not limited thereto and may vary based on various voice information of the talker or user definition.

The controller 200 generates the tuned masking sound and controls the speaker 300 to output the tuned masking sound (2105).

In detail, the controller 200 may control the speaker 300 to output the masking sound whenever the talker starts to speak. In addition, the controller 200 may determine a point in time when the talker starts to speak, and may store information on the voice pattern of the talker in advance in order to determine the point in time when the talker speaks.

According to the embodiment, when the talker utters, "I have an appointment tonight, I'll go early.", the controller 200 may determine the first syllable of each word "to", "d", "ha", "earl" and "go", as the signal of output the masking sound, and the controller 200 may control the speaker 300 to generate the masking sound.

However, this is only an embodiment of the present disclosure, and the controller 200 may store voice information of the talker, and may use the starting point of each sentence spoken by the talker as a signal for outputting a masking sound.

Figure 4:
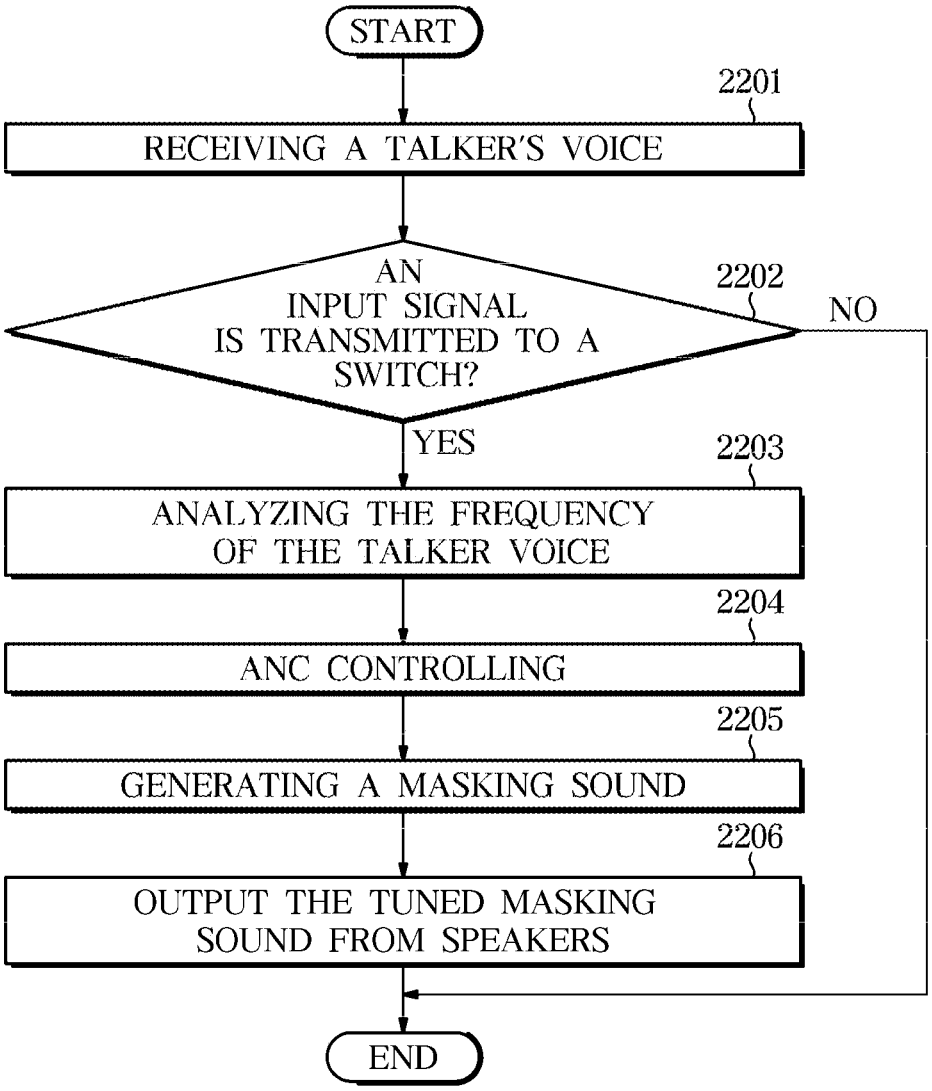
FIG. 4 is a flow chart illustrating that the controller of the vehicle according to the embodiment of the disclosure controls the voice of the talker and generates a masking sound tuned based on the voice of the talker.

FIG. 4 is a flowchart illustrating a process of controlling the speaker 300 to output a masking sound based on a voice frequency of a talker and to generate a tuned masking sound according to the disclosed embodiment.

As described above, the controller 200 receives a voice of the talker from the microphone 100 (2201), and generates a masking sound when the talker inputs an input signal for generating a masking sound (2202). However, when the talker does not input the input signal for generating the masking sound, the controller 200 terminates the masking sound generation process.

The controller 200 may analyze the frequency of the talker voice based on the input signal of the talker (2203). The voice frequency of the talker may include information about the loudness, height and tone of the talker voice.

The controller 200 performs frequency control (ANC control) based on the analyzed talker voice frequency information (2204).

The ANC control means a control method that generates a sound having a frequency overlapping with the talker's voice frequency and cancels the talker's voice.

In detail, the controller 200 may generate a masking sound having a frequency opposite to that of the talker received from the microphone 100. Masking sound having a frequency opposite to that of the talker voice causes an overlapping phenomenon with the talker's voice frequency and may cancel the talker's voice by the overlapping phenomenon. However, the present disclosure is not limited to the frequency control ANC control and may include another control method capable of canceling the talker voice based on the frequency information of the talker voice.

In addition, when the controller 200 receives the sound of the talker located in the first seat 2 by the microphone 100 the controller 200 may control the speaker 300 so that the speaker provided in the second seat 3 outputs a masking sound canceling the voice of the talker based on the input sound, through the above-described frequency control.

In addition, the controller 200 may create an independent sound field as a result of performing voice control to cancel the voice of the talker in each seat. The independent sound field refers to an area in which each seat has an independent acoustic space and cannot detect voices generated from other seats, even if a plurality of talkers is uttered in the plurality of seats provided in the vehicle 1.

When the frequency control (ANC control) of the masking sound ends, the controller 200 may generate a tuned masking sound (2205). As described above, the controller 200 may tune the masking sound such that the masking sound becomes smaller and smaller, and is delayed output alternately for a predetermined time in the speaker 300 provided on the left and right of the headrest 4.

In addition, the masking sound may be the above-described frequency controlled (ANC controlled) sound. However, the tuned masking sound is not limited thereto, and other tuning methods may be used depending on user definition, voice information of the talker, and the type of vehicle.

When the controller 200 generates the tuned masking sound, the controller 200 controls the speaker 300 to output the masking sound (2206).

FIG. 5 is a flowchart illustrating that the controller 200 controls the speaker 300 to output the background sound by the speaker according to the disclosed embodiment.

The controller 200 receives the talker's voice from the microphone 100 (2301).

The controller 200 generates a background sound when the talker inputs an input signal for generating a background sound based on the received talker's voice (2302).

However, when the talker does not input the input signal for generating the background sound, the controller 200 terminates the background sound generation process.

The controller 200 receives an input signal of the talker and analyzes the voice of the talker (2303).

Specifically, according to one embodiment, the controller 200 may analyze the language of the talker in order to control the speaker 300 to output an appropriate background sound to the talker and the passenger of the vehicle 1. In addition, according to another disclosed embodiment, the controller 200 may analyze language habits and gender from the voice of the talker. However, the voice information of the talker analyzed by the controller 200 is not limited thereto, and may further include a variety of information for outputting an appropriate background sound to the talker.

The controller 200 may analyze location information of the vehicle based on the sensing information of the GPS sensor provided in the vehicle 1 (2304). The controller 200 may generate a background sound to be described later based on the analyzed location information.

The controller 200 may generate a background sound based on the talker's voice and/or the location information of the vehicle 1 (2305).

In detail, the controller 200 may basically use natural sounds such as water sounds and bird sounds as background sounds. However, according to an embodiment of the present disclosure, when the voice of the talker and/or the location information of the vehicle 1 are analyzed and it is determined that the talker uses Chinese and the vehicle 1 is located in China, the controller 200 may generate Chinese songs with background sounds.

According to another disclosed embodiment, when the talker speaks Korean and the vehicle 1 is determined to be in the United States, the controller 200 may generate a Korean song as a background sound. However, the background sound is not limited thereto and may vary depending on user definition.

The controller 200 controls the speaker 300 to output the generated background sound (2306). On the other hand, the speaker 300 may output not only the background sound or the above-mentioned masking sound but also output both the background sound and the masking sound.

Specifically, the background sound may be not only one sound but a plurality of sounds, and may be output alternately. In addition, when the masking sound and the background sound are output together, the controller 200 may output or continue to output the masking sound for a specified time whenever the background sound is changed. In addition, when the masking sound and the background sound are output together, the controller 200 may repeatedly output the masking sound.

According to an embodiment of the present disclosure, the controller 200 may store a plurality of background sounds and output a natural sound as a first background sound. However, when the passenger does not want this, the controller 200 may output a song as a second background sound. In addition, the controller 200 may output the masking sound continuously or repeatedly for a specified time every time the first background sound is changed to the second background sound.

However, this is only an embodiment of the present disclosure, and the timing and period at which the masking sound is output may vary depending on user-definition and preset criteria.

FIG. 6A illustrates that the speaker 300 according to the embodiment of the disclosure is inclined at 45°, FIG. 6B illustrates that there are two 45° inclined speakers 300 at right and left side and FIG. 6C illustrates the headrest 4 (*c*) to which the speaker 300 is mounted.

The speaker 300 may be mounted to the headrest 4 and may include a plurality of speakers.

In detail, according to the embodiment, the speaker 300 may be provided on the left and right of the headrest 4, and may be installed at a 45° angle at the rear side from the talker or the passenger based on the contact surface of the seat and the talker or the passenger. In addition, according to another embodiment disclosed, the speaker 300 is provided on the left and right of the headrest 4, and the speaker 300 may be installed at 45° angle at the rear and lateral side from the talker or the passenger based on the contact surface of the seat and the talker or the passenger. In addition, the speaker 300 according to an embodiment of the present disclosure may make a sound including all of the human audible frequency range so as to cancel the voice of the talker.

Meanwhile, referring to FIGS. 6A and 6B, when the speaker 300 is installed at an angle of 45°, the speaker 300 has an effect of collecting masking sound or background sound generated.

Figure 6:
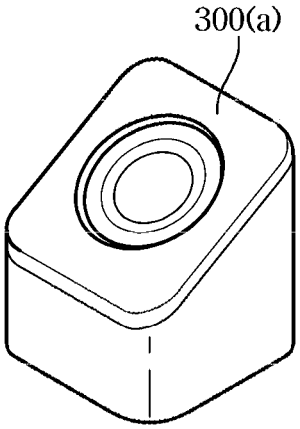
FIG. 6 shows that a speaker and the speaker according to the embodiment are installed in a headrest.
Figure 6:
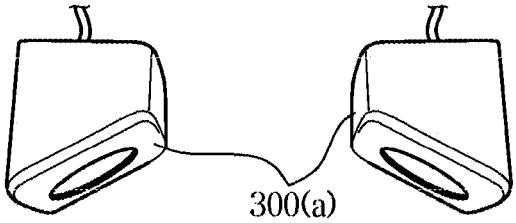
Figure 6:
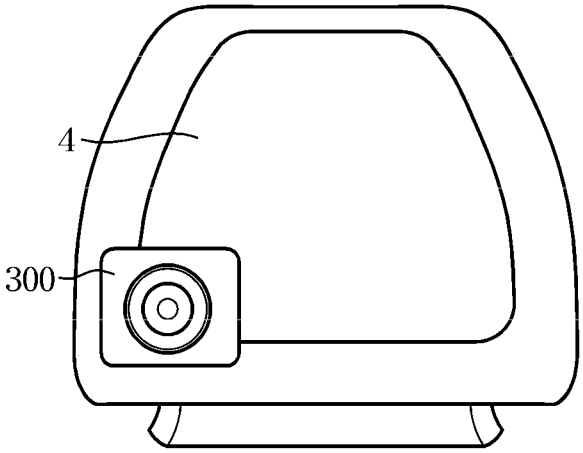

Also, referring to FIG. 6 C, when the speaker 300 is installed in the headrest 4 of the vehicle 1, the speaker 300 may be installed at the position of the passenger's ear or the talker's ear and thus the passenger seated in the second seat 3 can efficiently hear the masking sound or the background sound.

Figure 7:
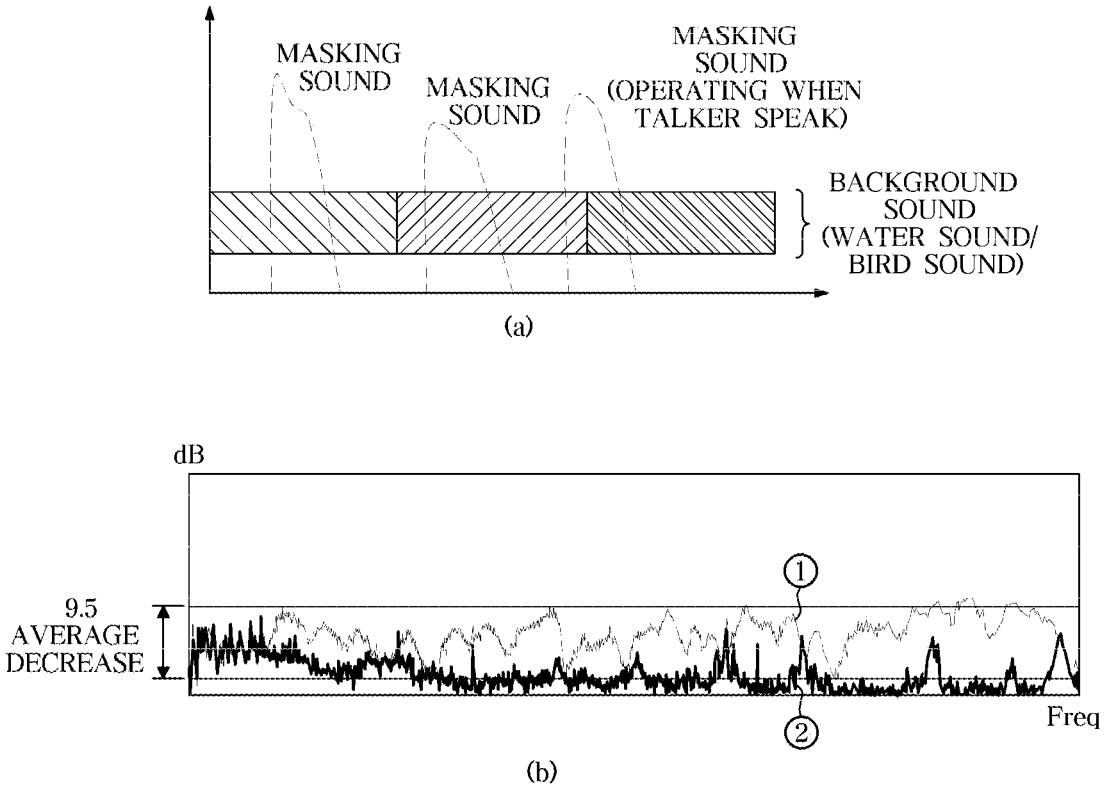
FIG. 7 shows the results of output of the masking sound and the background sound according to a control method of the vehicle according to the embodiment.

FIG. 7 illustrates a waveform of a canceled talker's voice when the speaker 300 outputs a masking sound and a background sound according to an embodiment.

FIG. 7 A shows waveforms when the speaker 300 simultaneously outputs a masking sound and a background sound. As described above, the masking sound may be a sound canceling the voice of the talker, and the background sound may be a preset sound such as a natural sound.

In detail, the controller 200 may generate a masking sound while the talker speaks. On the other hand, the background sound has a constant frequency waveform in preparation for the sudden speech of the talker, and the background sound may be continuously generated for a predetermined time. The predetermined time may be a time from a moment when the talker inputs an input signal to generate a masking sound or a background sound to a time when the talker ends a conversation with a third party. However, the predetermined time is not limited to this and may vary depending on user definition.

FIG. 7 B shows the voice signal waveform (①) and the voice waveform of the talker (②) detected by the second seat after the voice of the talker is canceled by the masking sound or the background sound of the talker.

Specifically, in FIG. 7B, an x-axis means the frequency of the sound (Freq), and a vertical axis means the loudness (dB) of the sound.

Referring to FIG. 7B, when the voice frequency of the talker is 0 to 2 kHz, the speaker 300 superimposes the masking sound and the background sound on the voice of the talker received by the controller 200. The average decrease was 9.5 dB. However, this is only one example according to the disclosed embodiment and may vary depending on voice information of the talker, spatial information of the vehicle, and user definition.

Figure 8:
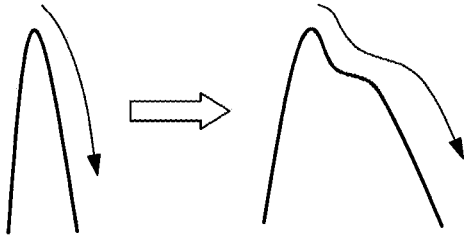
FIG. 8 illustrates a case where the masking sound fades out and is delayed output according to the control method of the vehicle according to the embodiment.
Figure 8:
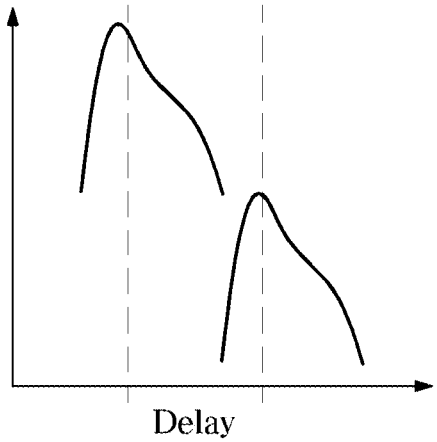

FIG. 8 is a waveform of sound when the controller 200 according to the present embodiment outputs the masking sound gradually smaller based on a predetermined time and when the output of the masking sound is delayed by the speaker 300 provided on the left and right of the headrest 4.

Specifically, FIG. 8 A shows the waveform of the sound before the controller 200 controls the masking sound and the waveform of the sound when the masking sound is faded out.

Referring to FIG. 8 A, the left waveform shows the masking sound waveform before the controller 200 controls the fading out of the masking sound. The right waveform shows the masking sound waveform after the controller 200 controls the masking sound to fade out.

According to the disclosed embodiment, the fade out control method may be to gradually output a masking sound smaller for a predetermined time. In addition, the fade out control method may be a control method for asymmetrically generating an output waveform of the masking sound as well as outputting the masking sound gradually smaller for a predetermined time. When the controller 200 outputs a fade out controlled masking sound, the masking sound has a large magnitude change at the start of the output, and a smooth change of the masking sound at the end of the output. In addition, when the controller 200 outputs a fade out controlled masking sound, the change of the masking sound at the end of the masking sound control shows a non-linear graph form. However, the degree to which the controller 200 changes the magnitude of the masking sound through the fade out control is not limited thereto, and may vary depending on preset criteria or user definition.

Referring to FIG. 8B, the controller 200 may control the masking sound to be alternately delayed through the speaker 300 provided on the left and right of the headrest 4 of the vehicle 1.

Specifically, as shown in the embodiment disclosed FIG. 8B, when the delayed output of the masking sound from the speaker 300 provided on the left and right of the headrest 4 at a predetermined time interval, it becomes difficult for a passenger other than the talker to recognize the voice of the talker.

Figure 9:
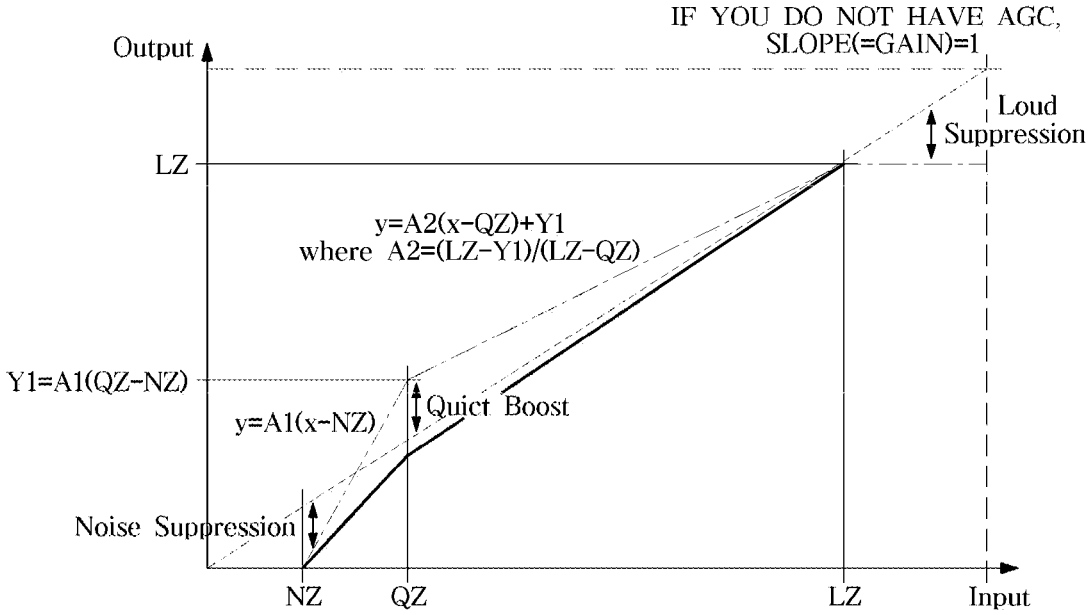
FIG. 9 shows an output value when the controller according to the embodiment performs automatic input value control (auto gain control: AGC) to a microphone.

FIG. 9 shows that the echo problem of the microphone is improved when the controller 200 according to the embodiment performs auto gain control (AGC) on the microphone 100.

Specifically, referring to FIG. 9, the horizontal axis of the graph according to the disclosed embodiment represents a voice input value of the talker, and the vertical axis represents an output value based on the voice of the talker received by the microphone 100.

Referring to FIG. 9, the controller 200 according to the disclosed embodiment sets a parameter for performing auto gain control (AGC), such as NZ is a noise zone level, QZ is a Quiet Zone Level), and LZ is a Loud Zone Level.

In addition, the controller 200 according to the disclosed embodiment may set the slope value A1 of the graph to the output value Gain at the quiet zone level based on the parameters.

According to the embodiment, the controller 200 may calculate a Y1 value and an A2 value based on the Noise Zone Level (NZ), Quiet Zone Level (QZ), Loud Zone Level (LZ), and the inclination value A1 . . . . The controller 200 may calculate a Y1 value and an A2 value by the following equation.

$$Y1=A1(QZ-NZ)$$

$$A2=(LZ-Y1)/(LZ-QZ)$$

The controller 200 according to the disclosed embodiment may perform an automatic input value control (auto gain control: AGC) to have a Quiet Boost effect in Quiet Zone Level (QZ) when the A2 value calculated using the above formula is smaller than 1.).

The Quiet Boost effect may refer to an effect that the talker's voice is automatically widened to have a sufficient output value even when the speaker 300 generates a masking sound or a background sound according to the disclosed embodiment.

Specifically, before the controller 200 according to the disclosed embodiment performs auto gain control (AGC), the talker's voice is linearly input to the microphone 100 and output an A1 value as 1. However, when the controller 200 according to the disclosed embodiment performs input gain control (AGC: Auto Gain Control), the controller 200 may perform Loud Suppression configured to reduce the volume of the talker's voice that is larger than the loud zone level (LZ), perform Noise Suppression configured to reduce the noise when more noise signals are detected than Noise Zone Level (NZ), and perform Quiet Boost configured to amplify the input value when an input value smaller than Quiet Zone Level (QZ) is input.

Through such control, the controller 200 may remove noise generated by the masking sound and the background sound. In addition, the controller 200 may REF tune to the microphone 100 that uses the talker's voice as an input value and limits the output value within a predetermined range. As a result of the REF tuning, the controller 200 may improve an echo problem of the microphone 100 in which the microphone 100 input values are different depending on the structure of the vehicle or the spatial area information of the vehicle. The controller 200 may adjust the sensitivity of the input value in performing the control.

However, the control method of the controller 200 according to the disclosed embodiment is not limited thereto, and each parameter value may be changed or added depending on a user definition. As is apparent from the above description, the vehicle and the method of controlling the vehicle according to the disclosed aspect analyzes the voice of the vehicle talker and generates a masking sound or a background sound based on the voice analysis result so as to prevent other people in the vehicle from hearing the voice of the vehicle talker, thereby protecting the privacy of the talker.

embodiments of the present disclosure have been described above. In the embodiments described above, some components may be implemented as a "module". Here, the term 'module' means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

With that being said, and in addition to the above described embodiments, embodiments can thus be implemented through computer readable code/instructions in/on a medium, e.g., a computer readable medium, to control at least one processing element to implement any above described embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

Logical blocks, modules or units described in connection with embodiments disclosed herein can be implemented or performed by a computing device having at least one processor, at least one memory and at least one communication interface. The elements of a method, process, or algorithm described in connection with embodiments disclosed herein can be embodied directly in hardware, in a software module executed by at least one processor, or in a combination of the two. Computer-executable instructions for implementing a method, process, or algorithm described in connection with embodiments disclosed herein can be stored in a non-transitory computer readable storage medium.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A vehicle comprising, a first seat in which a first person is seated;

a second seat in which a second person is seated;

a plurality of speakers provided around or in the first seat and the second seat;

a microphone configured to receive the first person's voice; and a controller configured to control the plurality of speakers to output a masking sound tuned based on the first person's voice and control auto gain control sensitivity of the microphone based on the masking sound so that the microphone reduces a received additional voice, wherein the controller is further configured to tune the masking sound such that the masking sound is delayed output alternately for a predetermined time in the plurality of speakers, generate asymmetrically an output waveform of the masking sound, and control simultaneously to gradually reduce the volume of the masking sound output for a predetermined time.

2. The vehicle according to claim 1, wherein at least one of the speakers is provided in a headrest of each or one of the first seat and the second seat.

3. The vehicle according to claim 1 further comprising:

a speaker system having two channels and comprising first and second ones of the plurality of speakers being provided on left and right sides of the headrest of the second seat, respectively;

wherein the controller is configured to control the first and second speakers so that the masking sound of the second speaker is delayed with respect to that of the first speaker.

4. The vehicle according to claim 1, wherein the controller outputs background sounds.

5. The vehicle according to claim 4, further comprising:

a GPS sensor;

wherein the controller outputs the background sound based on location information of the vehicle.

6. The vehicle according to claim 4, wherein the controller controls the auto gain control sensitivity of the microphone based on a magnitude of the background sound.

7. The vehicle according to claim 6, wherein the controller determines the frequency of the voice of the first person and the phase of the voice of the first person, and outputs a tuned masking sound to cancel the determined frequency.

8. The vehicle according to claim 4, wherein the controller stores the plurality of background sounds, and outputs the masking sound according to a preset criterion when the first person starts speaking or when the background sound changes.

9. The vehicle according to claim 6, further comprising:

an input unit configured to receive an operation start command.

10. A method of controlling a vehicle, comprising;

receiving voice of a first one of persons seating in the vehicle by a microphone;

controlling a plurality of speakers to output a masking sound tuned based on the first person's voice by a controller; and controlling auto gain control sensitivity of the microphone based on the masking sound so that the microphone amplifies or reduces a received additional voice, wherein the controlling of the plurality of speakers includes tuning the masking sound such that the masking sound is delayed output alternately for a predetermined time in the plurality of speakers, generating asymmetrically an output waveform of the masking sound, and controlling simultaneously to gradually reduce the volume of the masking sound output for a predetermined time.

11. The method according to claim 10, wherein the plurality of speakers comprises speakers provided at a headrest of a first seat and a second seat.

12. The method according to claim 10, wherein the controlling of the plurality of speakers comprises controlling each of the plurality of speakers provided on left and right sides of the headrest of the second seat and having two channels so that the masking sound is delayed output.

13. The method according to claim 10, wherein the controlling of the plurality of speakers comprises outputting a background sound.

14. The method according to claim 13, further comprising:

outputting the background sound based on the location information of the vehicle.

15. The method according to claim 13, wherein controlling the auto gain control sensitivity of the microphone is further based on a magnitude of the background sound.

16. The method according to claim 10, wherein the controlling of the plurality of speakers comprises determining a frequency of the first person's voice and a phase of the first person's voice, and outputting a tuned masking sound that cancels the determined frequency.

17. The method according to claim 16, wherein the controlling of the plurality of speakers comprises outputting the masking sound according to a preset criterion when the first person starts speaking or when the background sound changes.

18. The method according to claim 10, further comprising, receiving an operation start command by an input unit.

* * * * *